United States Patent [19]

Löffler

[11] Patent Number: 4,930,395

[45] Date of Patent: Jun. 5, 1990

[54] PROJECTILE FOR ELECTRIC RAIL GUNS

[75] Inventor: Markus Löffler, Unterlüss, Fed. Rep. of Germany

[73] Assignee: TZN Forschungs- und Entwicklungszentrum Unterlüss GmbH, Unterlüss, Fed. Rep. of Germany

[21] Appl. No.: 351,517

[22] Filed: May 15, 1989

[30] Foreign Application Priority Data

May 13, 1988 [DE] Fed. Rep. of Germany ..... 3816299

[51] Int. Cl.[5] ..... F41B 6/00

[52] U.S. Cl. ..... 89/8; 102/526; 124/3; 174/126.2

[58] Field of Search ..... 89/7, 8; 102/524, 526; 124/3; 174/126.2

[56] References Cited

U.S. PATENT DOCUMENTS

| | | | |
|---|---|---|---|
| H,237 | 3/1987 | Levy | 89/8 |
| 1,421,435 | 7/1922 | Fauchon-Villeplee | 124/3 |
| 4,369,692 | 1/1983 | Kemeny | 89/8 |
| 4,480,523 | 11/1984 | Young et al. | 89/8 |

FOREIGN PATENT DOCUMENTS 448496 6/1936 United Kingdom .

*Primary Examiner*—Stephen C. Bentley
*Attorney, Agent, or Firm*—Spencer & Frank

[57] ABSTRACT

A projectile intended to be fired from an electric rail gun having spaced current-carrying rails between which the projectile is accelerated when fired, includes an armature mounted on the projectile and arranged to make contact simultaneously with the rails to electrically connect the rails to one another. The armature is of annular configuration and rotates as the projectile is propelled through the electric rail gun.

8 Claims, 2 Drawing Sheets

PROJECTILE FOR ELECTRIC RAIL GUNS

CROSS REFERENCE TO RELATED APPLICATION

This application claims the priority of Federal Republic of Germany Application No. P 38 16 299.7 filed May 13, 1988, which is incorporated herein by reference.

BACKGROUND OF THE INVENTION

This invention relates to a projectile for electric rail guns and is of the type which has at its tail end an armature which serves as a current bridge between the current carrying rails of the gun.

Projectiles which are fired from rail guns are conventionally provided with an armature which serves as a current bridge between the gun rails. It is a desideratum that the armature establish a metal contact between the rails with the lowest possible electric resistance. Such armatures operate satisfactorily often only up to projectile velocities of a few hundred meters per second. At higher velocities, arcing between the armature and the rails occurs which causes a significant erosion of the contact faces of the armature thus leading to unnecessary energy losses and to a reduction of efficiency. The appearance of arcs is caused by the metal abrasion caused by the high contact currents. The removed metal particles leave gaps between the armature and the current-carrying rails and thus cause deterioration of the electric contact. Further, conventional metal contact armatures have a relatively high mass which has to be accelerated together with the mass of the projectile.

In order to avoid arcing, conventionally the projectiles have been often provided at their tail end with a metal foil which, at the initial passage of current, explosively vaporizes and forms a plasma. Such a "plasma armature" while functioning satisfactorily even at the highest projectile velocities has a high electric resistance and thus significantly reduces the efficiency of the rail accelerator.

SUMMARY OF THE INVENTION

It is an object of the invention to provide an improved projectile of the above-outlined type which has a metal armature that avoids arcing.

This object and others to become apparent as the specification progresses, are accomplished by the invention, according to which, briefly stated, the projectile armature is of annular configuration and rotates while the projectile moves through the barrel of the rail gun.

Thus, according to the invention, a reduction of the metal erosion and thus an improvement of the contact between armature and rail is achieved by ensuring that the respective contact faces of the armature are not exposed to the contact load (stress) during the entire acceleration and that they are at least partially replaced by new contact faces. This is achieved by an annular configuration of the armature and by imparting a rotation thereto, whereby a continuous load on the contact face is avoided. Furthermore, the annular configuration results in a reduction of the armature mass.

DESCRIPTION OF THE PREFERRED EMBODIMENT

Figure 1:
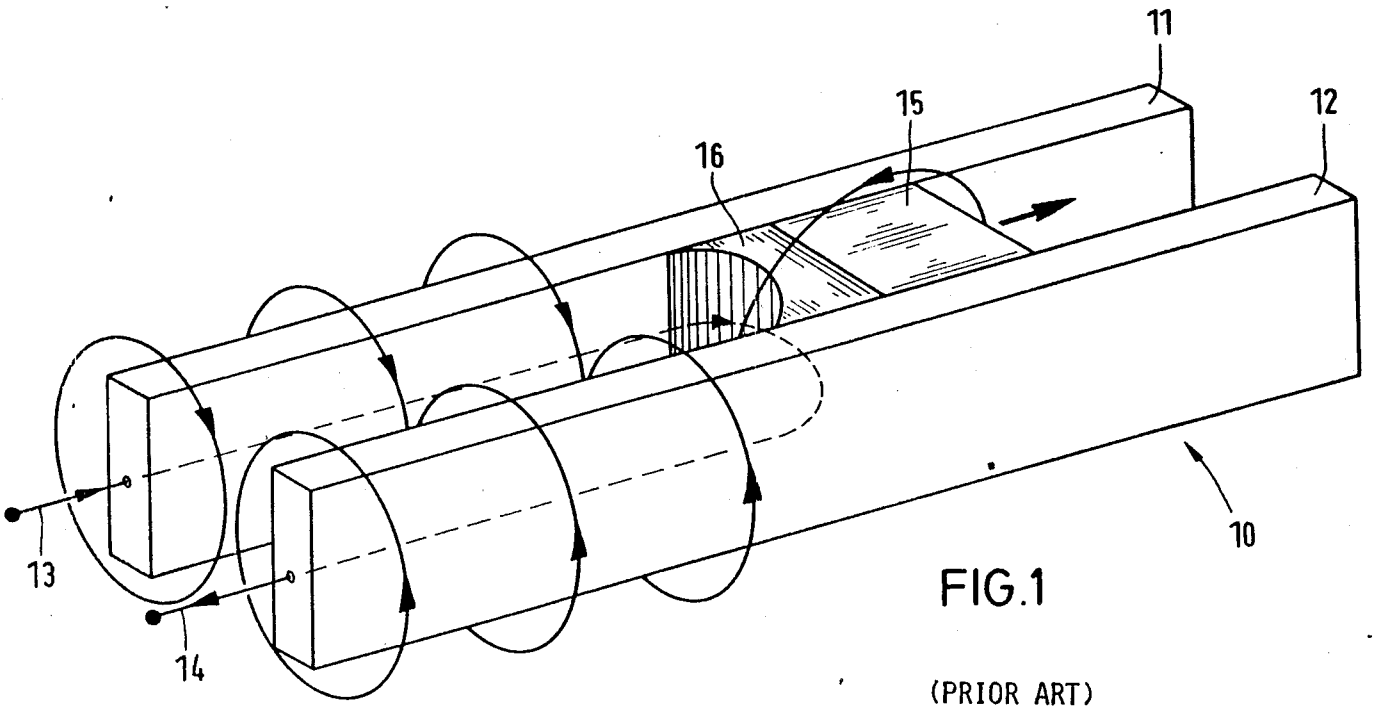
FIG.1 (PRIOR ART)
FIG. 1 is a schematic perspective view of a rail-type projectile accelerator according to the prior art.

Turning to FIG. 1, there is illustrated a rail gun 10 which comprises two parallel-spaced current rails 11 and 12. Current is applied to the rails 11 and 12 by conductors 13 and 14. The projectile 15 to be accelerated is disposed between the rails 11 and 12 and has, at its tail end, an armature 16.

When current flows through the conductors 13 and 14, by virtue of a magnetic alternating effect of the magnetic fields generated about the rails 11 and 12 and about the armature 16, the armature 16 and the projectile 15 connected thereto are propelled (accelerated) in the forward direction. Such a conventional electrical accelerator has the earlier-discussed disadvantages, namely, that at higher speeds arcing occurs which leads to unnecessary energy losses and to a reduction of efficiency.

Figure 2:
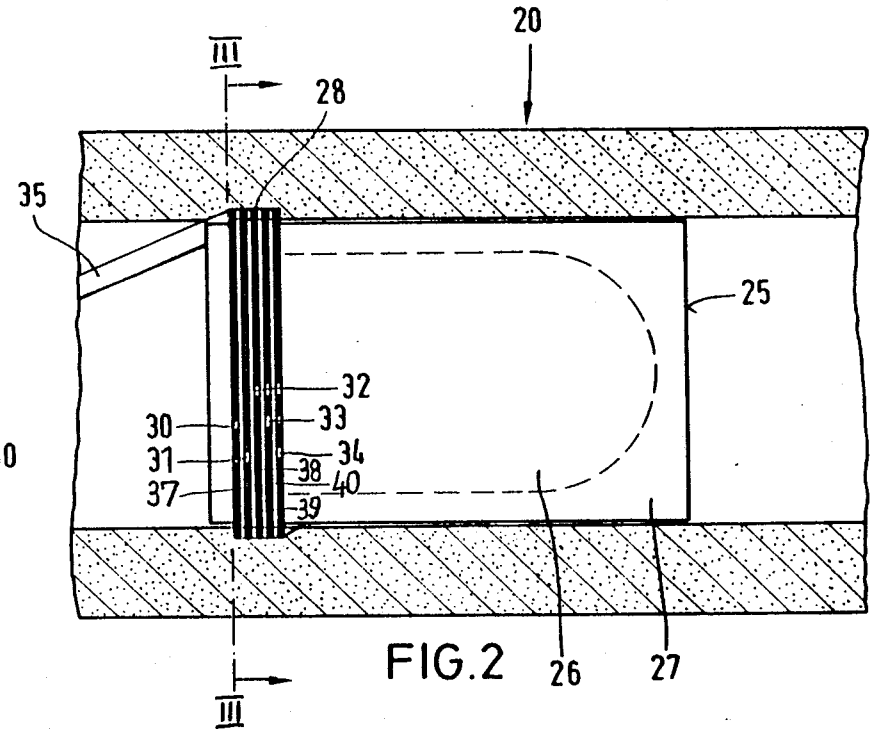
FIG. 2 is an axial sectional view of a rail accelerator incorporating a preferred embodiment of the invention.
Figure 3:
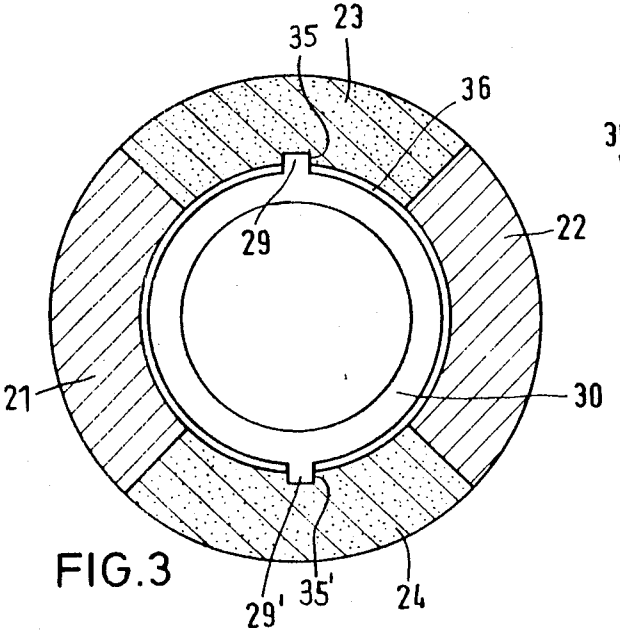
FIG. 3 is a sectional view taken along line III—III of FIG. 2.

Turning to FIGS. 2 and 3, there is illustrated therein a projectile accelerator 20 according to a preferred embodiment of the invention. The projectile accelerator 20 has current rails 21 and 22 situated diametrically opposite one another and separated by insulating rails 23 and 24. The rails 21–24 form a rail gun barrel. The projectile to be accelerated is designated at 25. It includes the shell 26 proper, a sabot 27 (formed of two separable halves that fall apart after the projectile has left the barrel) and an armature 28 at the tail end of the sabot. The armature 28 is formed of a stack of flat metal rings 30, 31, 32, 33 and 34 which alternate with insulating rings 37, 38, 39 and 40. The assembly formed of alternating metal and insulating rings results in a more uniform current distribution on the contact faces. The metal rings 30–34 short circuit the current rails 21 and 22 of the rail gun 20.

Expediently, the metal and/or insulating rings of the armature 28 have radially outwardly projecting tabs 29, 29' which engage in respective rifle grooves 35, 35' that extend helically in the rail gun 20. Viewed along the length of the rail gun, the helical grooves 35, 35' are provided in the insulating rails 23 and 24 as well as in the current carrying rails 21 and 22.

During the acceleration of the projectile 25 the armature 28 is rotated by the cooperation between the tabs 29, 29' on the one hand and the rifle grooves 35, 35' on the other hand. By virtue of such rotation, a continuous load on the contact faces is avoided. The metal rings may be rigidly secured to the sabot 27 or they may rotate relative thereto. In the latter case the rings themselves may form a rigid ring stack, or the rings may rotate relative to one another as well.

The metal rings may be made, for example, of boron-fiber reinforced aluminum which, on its working (contacting) circumference is provided with a burn-resistant layer 36 which may be tungsten, beryllium or a synthetic material.

As an exemplary embodiment, the armature 28 may have a total of seventeen metal rings each having a thickness of 2 mm and sixteen insulating rings each having a thickness of 1 mm. The armature whose length is thus 50 mm, has an outer diameter of 80 mm and an inner diameter of 60 mm. Each metal ring and each insulating ring has two projections (tabs) 29, 29' on its outer circumference.

It may be feasible to dispense with the projections (tabs) 29, 29' by providing that the armature 28 is a guide band and the gun barrel is rifled so that the fields of the barrel bite into the guide band upon firing and impart thereon the required rotation.

It will be understood that the above description of the present invention is susceptible to various modifications, changes and adaptations, and the same are intended to be comprehended within the meaning and range of equivalents of the appended claims.

What is claimed is:

1. In a projectile to be fired from an electric rail gun having spaced current-carrying rails between which the projectile is accelerated when fired; said projectile ;having an armature being mounted on the projectile and being arranged to make contact simultaneously with the rails to electrically connect the rails to one another; the improvement wherein said armature comprises a plurality of axially aligned rings of boron-fiber reinforce aluminum and includes means for imparting a rotation thereto as the projectile is propelled through the electric rail gun.

2. A projectile as defined in claim 1, wherein said means for imparting a rotation comprises a projection formed on and extending outwardly from the armature and is arranged for being received in a helical guide groove of the rail gun.

3. A projectile as defined in claim 1, wherein said means for imparting a rotation comprises two diametrically oppositely located projections formed on and extending radially outwardly from each ring and arranged for being received by helical guide grooves of the rail gun.

4. A projectile as defined in claim 1, further comprising insulating rings alternating with said rings for electrically insulating said rings from one another.

5. A projectile as defined in claim 1, wherein the rings have an outer circumferential surface covered with a burn-resistant layer arranged for contacting said current-carrying rails.

6. A projectile as defined in claim 5, wherein said layer is selected from the group consisting of tungsten, beryllium and carbon.

7. The combination of an electric rail gun with a projectile to be fired therefrom; said rail gun comprising a gun barrel including two current-carrying gun rails between which the projectile is accelerated when fired: said projectile comprising an armature including a plurality of axially aligned rings of boron-fiber reinforced aluminum and being arranged to make contact simultaneously with the rails to electrically connect the rails to one another; said gun barrel and said armature having cooperating means for imparting a rotation to said armature as the projectile is propelled through said barrel.

8. The combination as defined in claim 7, wherein said cooperating means comprises a helical guide groove provided in an inner wall face of said gun barrel and a projection formed on and extending outwardly from said armature and received in said helical guide groove.

* * * * *